US008390197B1

(12) United States Patent
Boland et al.

(10) Patent No.: US 8,390,197 B1
(45) Date of Patent: Mar. 5, 2013

(54) LONG ARC COLUMN GAS DISCHARGE TUBE

(75) Inventors: Steven G. Boland, Yorba Linda, CA (US); Steven H. Boland, Glendora, CA (US); Therlyn L. Brady, Alta Loma, CA (US); Walter D. Chapman, West Covina, CA (US); Charles W. Lewis, Claremont, CA (US)

(73) Assignee: Alta Advanced Technologies, Inc., Ontario, CA (US)

( * ) Notice: Subject to any disclaimer, the term of this patent is extended or adjusted under 35 U.S.C. 154(b) by 0 days.

(21) Appl. No.: 13/468,865

(22) Filed: May 10, 2012

Related U.S. Application Data

(60) Provisional application No. 61/485,546, filed on May 12, 2011.

(51) Int. Cl.
*H01J 17/16* (2006.01)
*H01J 61/00* (2006.01)

(52) U.S. Cl. ..... 313/634; 313/573; 313/493

(58) Field of Classification Search ..... None
See application file for complete search history.

(56) References Cited

U.S. PATENT DOCUMENTS 7,619,364 B2 * 11/2009 Yasuda ..... 315/56

FOREIGN PATENT DOCUMENTS

JP 2001-015073 * 1/2001

* cited by examiner

*Primary Examiner* — Ashok Patel
(74) *Attorney, Agent, or Firm* — Kenneth L. Green

(57) ABSTRACT

A low pressure Ultra Violet (UV) light source produces a high intensity output proportional to the inside diameter and length of a arc discharge column. The light source includes a cathode and anode contained within a high density ceramic body and a sapphire window mounted in line with the arc discharge column. The anode is in line with the arc column at the end opposite the sapphire window, and the cathode is disposed to an area outside the arc discharge column to which the arc moves through an aperture in the side of the arc discharge column structure. As the electrons move through the low pressure gas ionization of the gas occurs releasing photons in the UV region of the spectrum. The sum of the photons generated at each location along the arc discharge column produces the high intensity UV radiation that exits the lamp through a sapphire window.

27 Claims, 6 Drawing Sheets

LONG ARC COLUMN GAS DISCHARGE TUBE

The present application claims the priority of U.S. Provisional Patent Application Ser. No. 61/485,546 filed May 12, 2011, which application is incorporated in its entirety herein by reference.

BACKGROUND OF THE INVENTION

The present invention relates to a gas discharge tube, and more particularly to a gas discharge tube of high density material and an arc column producing a high intensity light source for spectroscopy, chromatography, or the like.

Low pressure high intensity arc lamps are typically made of quartz or glass which requires labor intense multiple glass transitions between the light output window and the body of the lamp to compensate for the large difference in thermal expansion between the body material and the window. When the gas within the lamp is Deuterium, such body material is not dense enough to eliminate the slow loss of the gas because of the permeability of the body material to Deuterium. The loss of Deuterium may also occur through window material used in the lamp. In order to extend the useful operational life of the lamp against the slow loss of Deuterium, the lamp wall and window are typically coated with a ceramic or glaze which reduces the gas permeability of the overall structure. The loss of Deuterium may be addressed by including a large amount of Nickel in the internal construction, which Nickel is presaturated with Deuterium prior to sealing the lamp with its final fill pressure. The slow release of Deuterium from the Nickel into the lamp replenishes of the lost Deuterium. Unfortunately, this process is labor intensive, requires many different materials, and uses gas permeable materials requiring special coatings. Additionally, control of the arc ball of currently manufactured Deuterium lamps is difficult and in some cases requires multiple DC sources.

BRIEF SUMMARY OF THE INVENTION

The present invention addresses the above and other needs by providing a gas discharge tube in which favorable stability is provided that has long life while realizing high luminance, and in which a light-emitting portion assembly is integrated into a unitized structure.

The present invention addresses the above and other needs by providing a low pressure Ultra Violet (UV) light source which produces a high intensity output proportional to the inside diameter and length of a first discharge path. The light source includes a cathode and anode contained within a high density ceramic body and a sapphire window mounted in line with the first discharge path. The anode is in line with the first discharge path at the end opposite the sapphire window, and the cathode is disposed to an area outside the first discharge path to which the arc moves through an aperture in the side of the first discharge path structure. The anode includes a target material to receive electrons from the plasma arc. An electric field is applied to the anode and cathode and the cathode includes an element to produce electrons which are accelerated through the first discharge path towards the anode in response to the electric field. As the electrons move through the low pressure gas ionization of the gas occurs releasing photons in the UV region of the spectrum. The sum of the photons generated at each location along the first discharge path produces the high intensity UV radiation which exits the lamp through a sapphire window.

In accordance with one aspect of the invention, a long arc column discharge tube is caused to discharge a predetermined light from a light exit window of a hermetically sealed container toward the outside by scaling gas into the hermetically sealed container, electrically connecting to first and second stem pins disposed in a standing position in a stem which is provided in the hermetically sealed container so as to extend in a tube axis direction, and generating discharge between an anode and a cathode. The gas discharge tube is characterized by: a first discharge path between the anode and cathode; and having an opening of predetermined length and diameter, restricting the arc size, producing high intense light output that is a summation of photons generated over the length of the column.

In accordance with another aspect of the invention, when high luminance light is to be produced, it is not simply a case of changing the diameter of the first discharge path, but also requires changing the length of the arc column, internal gas pressure, and arc current.

In accordance with yet another aspect of the invention, the gas discharge tube is fabricated from high density ceramic which is impermeable to Deuterium or other gas contained therein, and includes a window which is also impermeable to the Deuterium or other gas, and contains a minimum of conductive metal which must be electrically insulated from the gas discharge. Such gas discharge tube may be made of alumina with a window of sapphire, which materials have similar thermal expansions which allows them to easily seal together by means of a fused glass frit or metal braze. The use of a high density ceramic throughout enables all the components therein to be easily bonded together with a sealing method which is impermeable to the Deuterium or other gas without the need for multiple joints of intervening materials of varying thermal expansions.

In accordance with still another aspect of the invention, the gas discharge tube is fabricated with the anode offset from the axis of the first discharge path and the addition of a second sapphire window on axis and opposite the sapphire exit window through which the light from the gas discharge exits the lamp, enabling the addition of an external light source of differing wavelength emissions to be located at the second sapphire window and those wavelength emissions add to that produced in the gas discharge tube yielding multiple wavelength emissions from the sapphire exit window.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
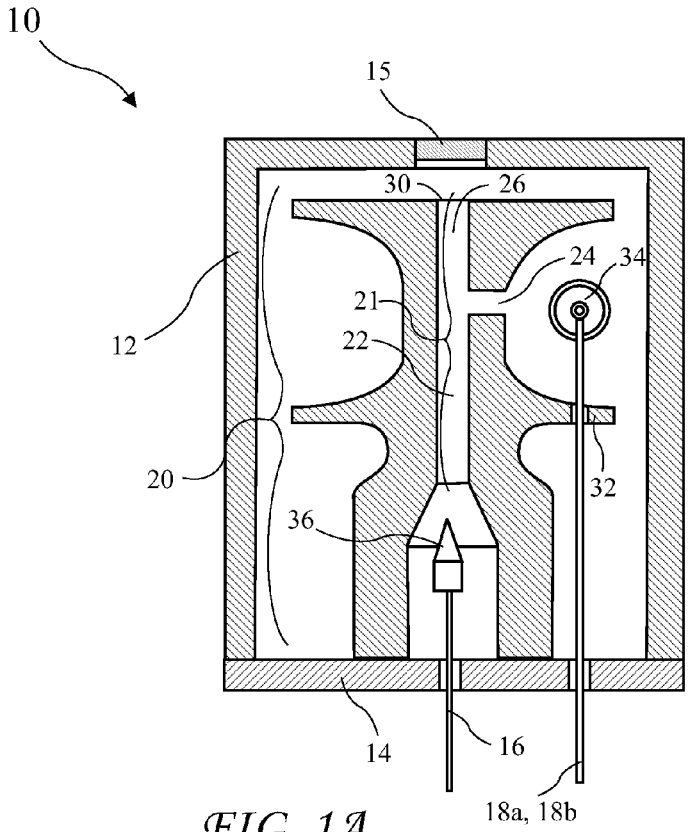
FIG. 1A is a cross-sectional view of the first embodiment of the long arc column discharge tube according to the present invention.
Figure 1B:
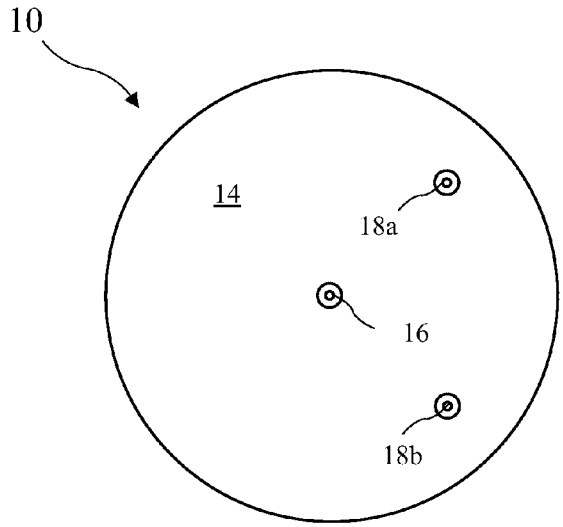
FIG. 1B is a bottom view of the long arc column discharge tube.

A long arc column discharge tube 10 is shown in FIG. 1A and a bottom view of the long arc column discharge tube 10 is shown in FIG. 1B. The long arc column discharge tube 10 includes a ceramic base 14, ceramic body 12, exit window 15, an anode stem 16 and cathode stems 18*a* and 18*b*, hermetically sealed (i.e., a gas tight container) into a single assembly. A ceramic long column structure 20 defines a first discharge path 22 directing the first discharge, a second discharge path 24 through a side aperture in the ceramic long column structure 20, a beam shaping column 26, an integral window shield 30, an integral cathode stem support 32, cathode 34, and an anode 36. A plasma arc discharge column comprises the first discharge path 22 and the beam shaping column 26. In another embodiment, the window shield is spaced apart from the long column structure 20.

Light is emitted by the Deuterium gas by passage of electrical current between the cathode 34 and anode 36 through the Deuterium gas, producing a gas discharge whose intensity is enhanced by the length and diameter chosen for the first discharge path 22. The second discharge path 24 allows completion of the discharge between the cathode 34, and anode 36.

The light exiting the first discharge path 22 is shaped by the length and diameter of the beam shaping column 26, and the diameter of the beam shaping column 26 may vary from the diameter of the first discharge path 22. The diameter of the beam shaping column 26 thus defines the width of the light pattern exiting the window 15.

The exit window shield 30 is made integral to the long column structure 20, for ease of fabrication and to keep the exit window 15 clear of any foreign material ejected from the cathode 34. The exit window shield 30 may be made from any non-electrically conducting material, and is preferably a ceramic material.

The cathode stem support 32, is made integral to the long column structure 20, for ease of assembly, support for cathode 34, and cathode stems 18*a* and 18*b*.

The long column structure 20, is sealed to the base 14, so the electric discharge is directed from anode 36, through the first discharge path 22 (plasma arc column), and the second discharge path 24, to the cathode 34.

The anode 36, is joined to the anode stem 16, which is sealed through base 14, allowing electric current to pass through base 14, to the anode 36, and can be made of a refractory metal, such as Tungsten, or of any appropriately doped material such as Cerium doped Tungsten. The anode 36 is shown with a sharp tip to ensure electric arc attachment be at the tip. The cathode 34, is joined at two places to cathode stems 18*a* and 18*b* (see FIG. 3A), allowing electric current to pass through base 14, to the cathode 34.

The exit window 15, is preferably sealed to the body 12 by means metal braze or glass frit, providing a hermetically sealed joint.

The body 12 and long column structure 20 are preferably sealed to base 14 by means of metal braze or glass frit, providing a hermetically sealed assembly. Positioning of the exit window 15, the long column structure 20, and the body 12 to the base 14, may be precisely located by means of grooves or shoulders that are made integral to the base 14, or the body 12.

Figure 2:
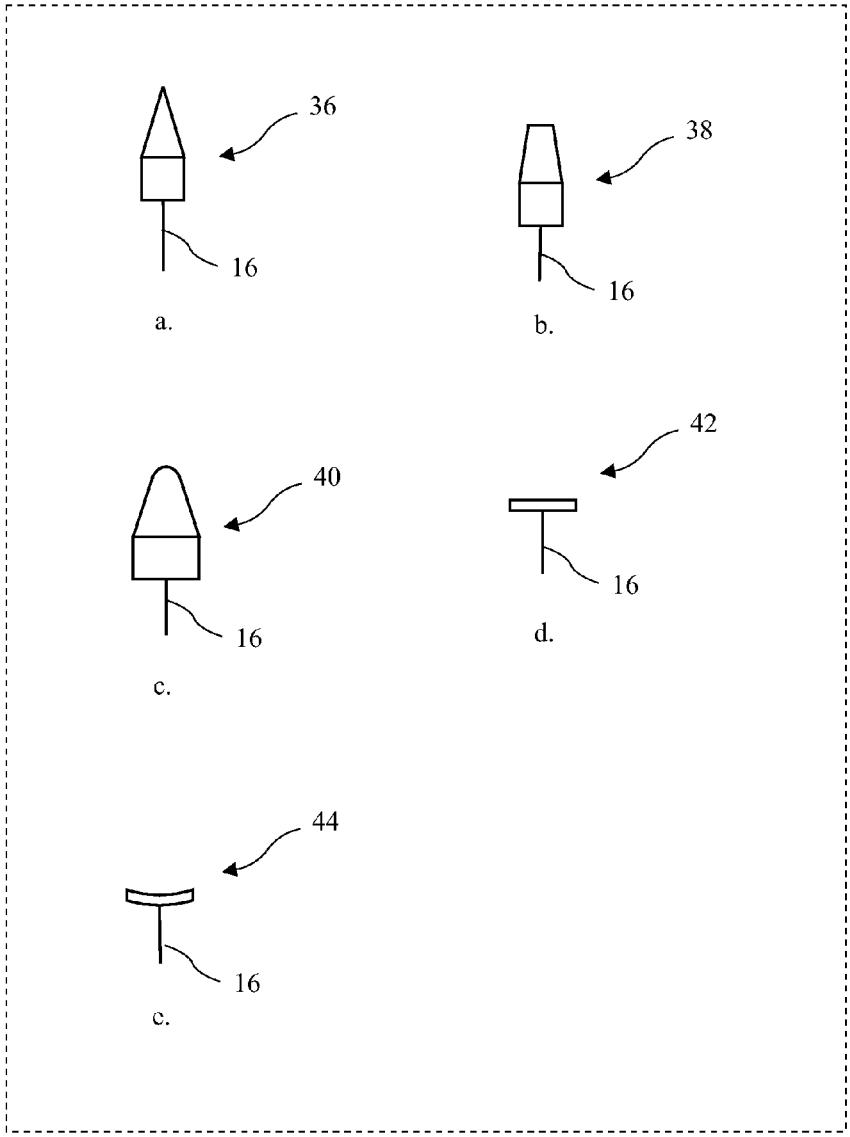
FIG. 2 shows different anode configurations that can be used in this gas discharge tube according to the present invention.

FIG. 2, shows five different anode configurations and are described as:

a) anode 36 which is a sharp pointed cone wherein the electric current of the gas discharge attaches directly to the point;

b) anode 38, is a truncated cone wherein the flat is dimensioned to match the electric current of the gas discharge;

c) anode 40, is a domed cone that enables the electric current of the gas discharge to envelope the dome where it is essential to maintain a lower temperature of the anode;

d) anode 42, is a flat disk wherein the electric current of the gas discharge is in contact at the center of the disk; and e) anode 44, is a curved disk (dish shape) having a radius defined by the distance between the end of the long column 6 first discharge path and the curved disk, enabling the total length of the gas discharge path between the cathode and anode to remain constant independent of the electric current contact point on the anode curved disk.

Any of the anodes of FIG. 2, can be made of a refractory metal, or one that is doped with a material that enhances release of electrons.

Figure 3:
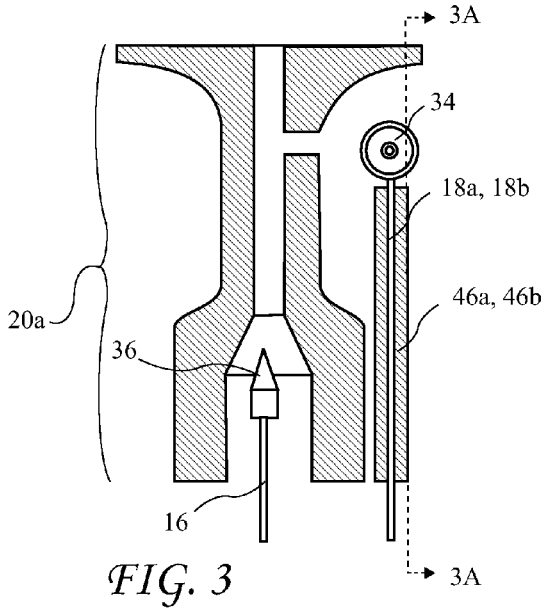
FIG. 3 is a cross-sectional view of the long arc column discharge tube with separate cathode lead wire supports according to the present invention.
Figure 3A:
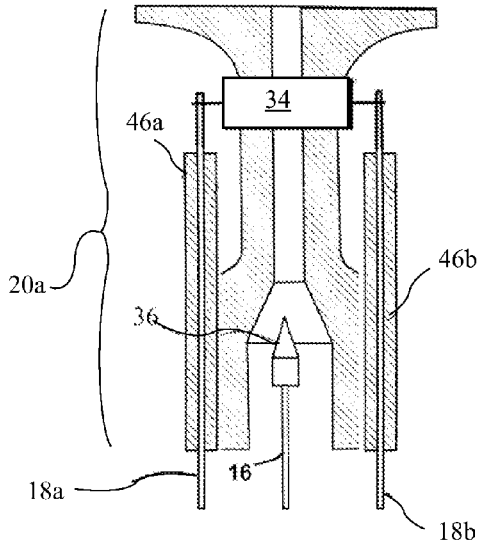
FIG. 3A is a cross-sectional view of the long arc column discharge tube according to the present invention taken along line 3A-3A of FIG. 3.

A first alternative embodiment of the long column structure 20*a*, without integral cathode stem supports, is shown in FIG. 3 and cross-sectional view of the long column structure 20*a* taken along line 3A-3A of FIG. 3 is shown in FIG. 3A. The long column structure 20*a* includes cathode supports 46*a* and 46*b* to support cathode stems 18*a* and 18*b*. The long column structure 20*a* is otherwise similar to the long column structure 20.

Figure 3B:
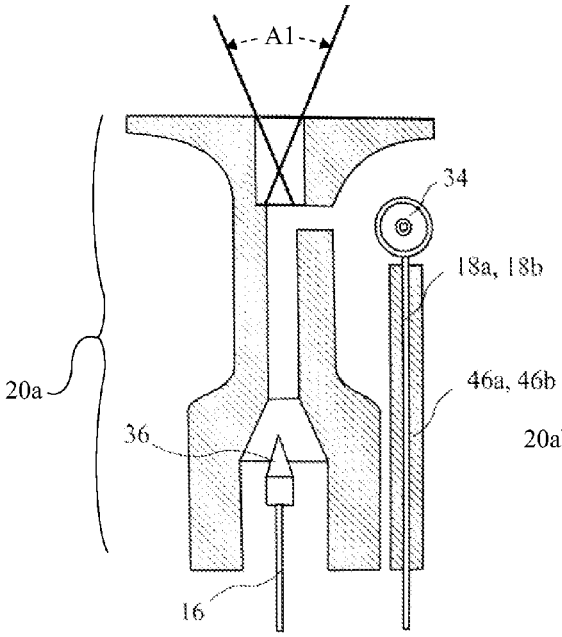
FIG. 3B is a cross-sectional view of the long arc discharge tube showing the beam shaping column defines the angle of the light exiting the first discharge path.
Figure 3C:
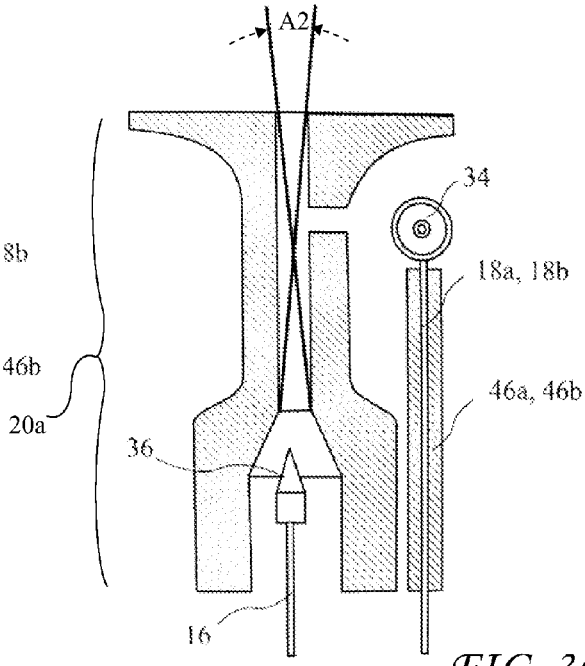
FIG. 3C is a cross-sectional view of the long arc discharge tube showing the change in shape of the angle of light exiting the first discharge path when the diameter of the first discharge path and beam shaping column are identical.

A cross-sectional view of the long arc discharge tube showing the beam shaping column defines a first exit angle A1 of the light exiting the first discharge path is shown in FIG. 3B and a cross-sectional view of the long arc discharge tube showing a second exit angle A2 of light exiting the first discharge path when the diameter of the first discharge path and beam shaping column are identical is shown in FIG. 3C.

Figure 4:
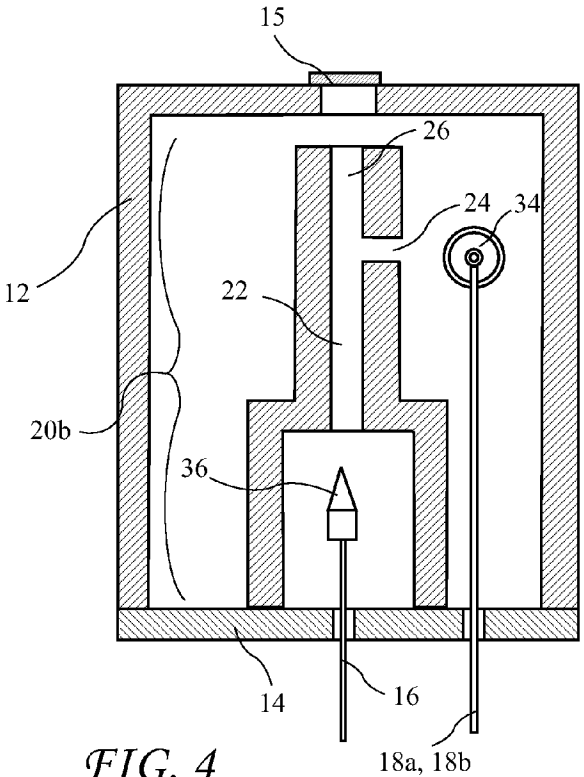
FIG. 4 is a cross-sectional view of the second embodiment of the long arc column discharge tube with free standing cathode according to the present invention.

A second alternative embodiment of the long column structure 20*b* is shown in FIG. 4. The long arc discharge tube 20*b* does not include an integral exit window shield or integral cathode stem support, and has free standing cathode stems 18*a* and 18*b* supporting the cathode 34.

Figure 5:
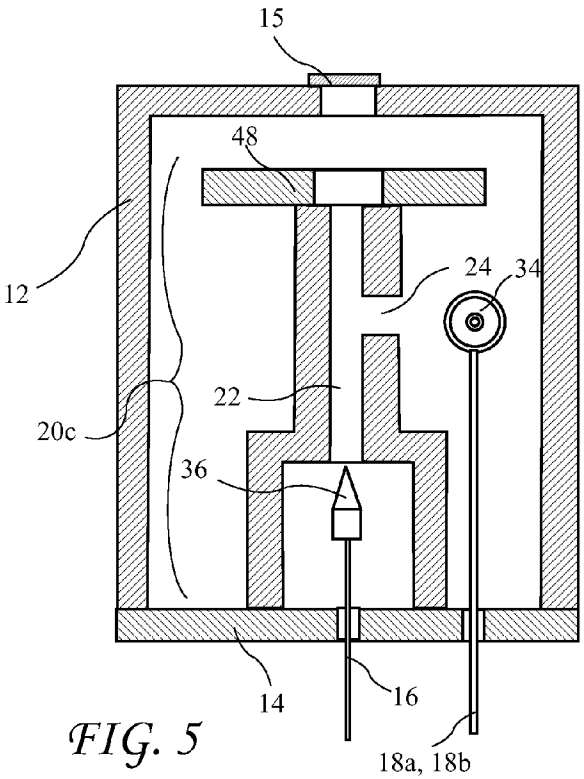
FIG. 5 is a cross-sectional view of the long arc column discharge tube of FIG. 4, with a separate window shield according to the present invention.

A third alternative embodiment of the long column structure 20*c* is shown in FIG. 5. The long column structure 20*c* includes a separate exit window shield 48 installed either by attachment to the long column structure 20*c*, or by separate means.

Figure 6:
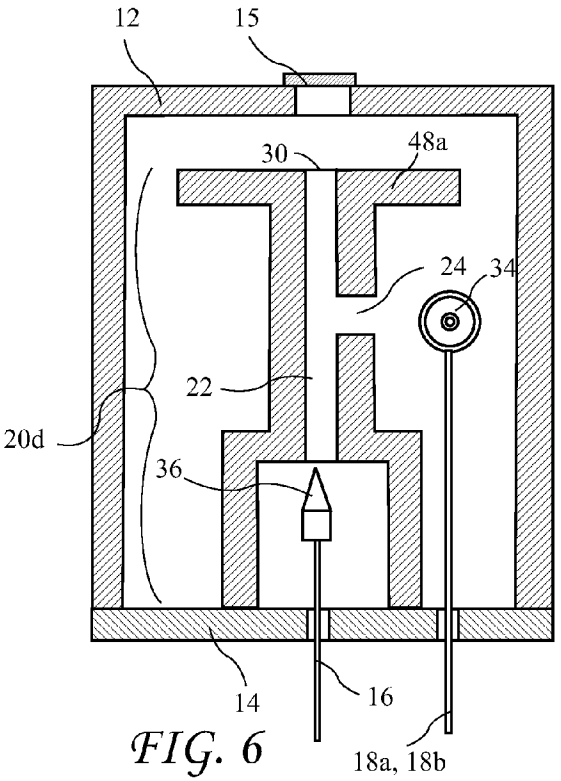
FIG. 6 is a cross-sectional view of the long arc column discharge tube of FIG. 5, wherein the window shield is an integral part of the long arc column according to the present invention.

A fourth alternative embodiment of the long column structure 20*d* is shown in FIG. 6. The long column structure 20*d* includes the exit window shield 30 as an integral part of long column structure 20*d*.

Figure 7:
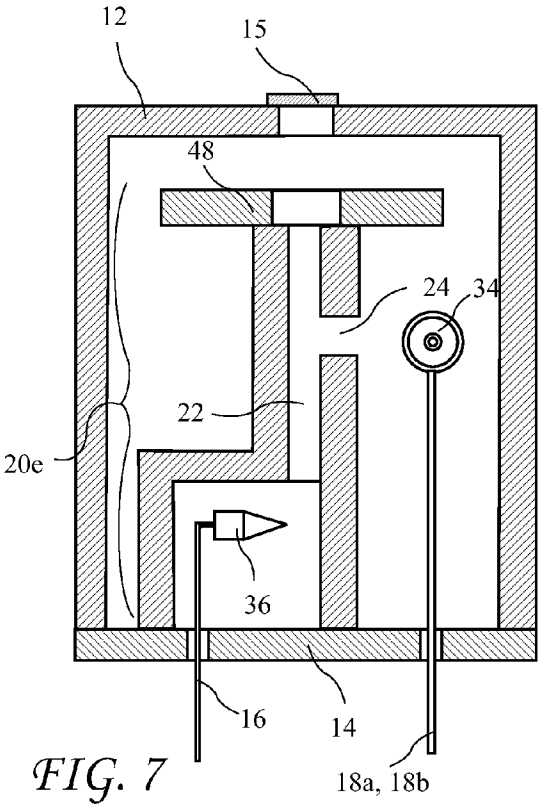
FIG. 7 is a cross-sectional view of the long arc column discharge tube of FIG. 5, wherein the anode is offset from the long arc column according to the present invention.

A fifth alternative embodiment of the long column structure 20*e* is shown in FIG. 7. When it is required the anode 36 not be in direct line with the first discharge path 22, the long column structure 20*e* may used with anode 36 horizontally offset from the first discharge path 22.

Figure 8:
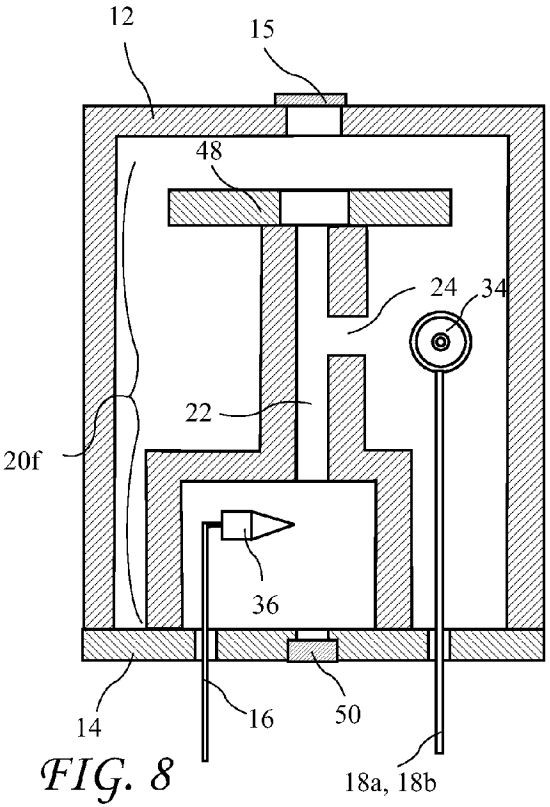
FIG. 8 is a cross-sectional view of the long arc column discharge tube of FIG. 7 having an additional sapphire window added on axis with and at the opposite end of the exit window according to the present invention.

A cross-sectional view of a sixth alternative embodiment of the long column structure 20*f* is shown in FIG. 8. The long column structure 20*f* has an additional sapphire window 50 added on axis with the exit window 15, but at an opposite end of the long arc column discharge tube residing in the base 14. The second sapphire window 50 may provide an additional light source having different wavelengths. The second sapphire window 50 enables photon emissions from an external light source to pass through the long column structure 20*f* and exit, along with the light produced by the gas discharge, through the gas discharge tube exit window 15.

Figure 9:
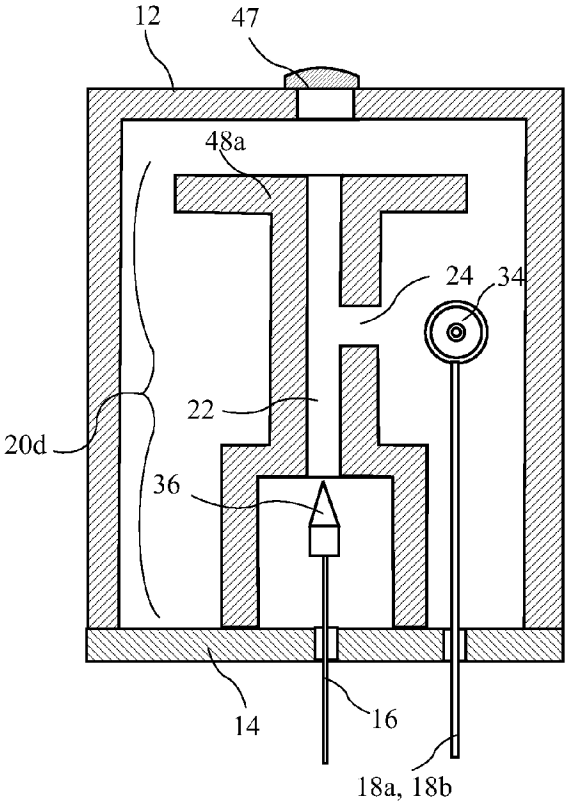
FIG. 9 shows a cross-sectional view of an alternative embodiment of a window according to the present invention.

A cross-sectional view of an alternative embodiment of a window 47 is shown in FIG. 9. The window 47 is formed as a lens allowing focusing of the light from the first discharge path 22 on an external target.

Figure 10:
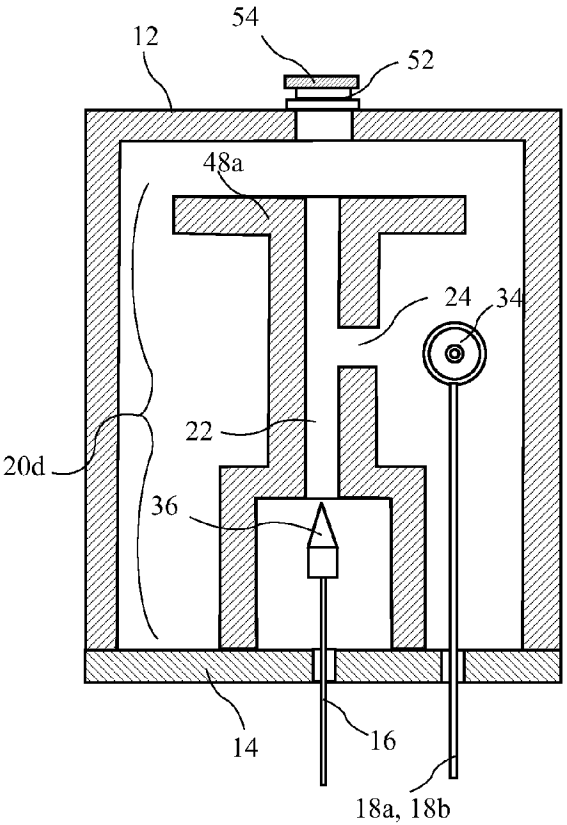
FIG. 10 shows a cross-sectional view of a second alternative embodiment of a window according to the present invention.

A cross-sectional view of a second alternative embodiment of window 54 is shown in FIG. 10. The window 54 has a different thermal expansion than sapphire. Window 54 is sealed to the body by means of an intervening thermal expansion material 52, such that little or no stress is applied to the window 54.

While the invention herein disclosed has been described by means of specific embodiments and applications thereof, numerous modifications and variations could be made thereto by those skilled in the art without departing from the scope of the invention set forth in the claims.

We claim:

1. A long arc column discharge tube comprising:

a hermetically sealed container containing a gas and made from a non-conductive material coated to be impermeable to the gas contained therein;

a light exit window in the hermetically sealed container;

an anode residing in the hermetically sealed container;

a cathode residing in the hermetically sealed container;

a long column structure residing in the hermetically sealed container, the long column structure including:

a narrow passage through the center of the long column structure;

a first discharge path in the narrow passage, the first discharge path creating light discharged from the narrow passage through the light exit window, wherein the discharged light is proportional to a gas density in the hermetically sealed container and is proportional to electric discharge current in the gas; and the first discharge path having a narrow column between the anode and cathode, wherein the length of the narrow column enables summation of light emitting photons along the narrow column length, and the length of the narrow column in conjunction with the diameter of the narrow column, shapes the light output from the first discharge path.

2. The long arc column discharge tube of claim 1, wherein the hermetically sealed container is made from material selected from ceramic, glass, and an internally coated material.

3. The long arc column discharge tube of claim 1, wherein the long column structure is composed of a high temperature insulating material compatible with the gas discharge environment.

4. The long arc column discharge tube of claim 1, further including cathode stems supporting the cathode.

5. The long arc column discharge tube of claim 4, further including a cathode stem support portion of the long column structure supporting the cathode stems.

6. The long arc column discharge tube of claim 1, wherein the cathode resides to the side of the long column structure and the long column structure further includes a second discharge path perpendicular to the first discharge path and aligned with the cathode.

7. The long arc column discharge tube of claim 6, wherein the cathode is mounted on free standing stems sealed into a base of the hermetically sealed container and held aligned with the second discharge path.

8. The long arc column discharge tube of claim 6, wherein the cathode is mounted on stems sealed into a base of the hermetically sealed container and held aligned with the second discharge path, the stems supported by cathode stem support portion of the long column structure.

9. The long arc column discharge tube of claim 6, wherein the cathode is mounted on stems sealed into a base of the hermetically sealed container and held aligned with the second discharge path, the stems supported by insulating sleeves.

10. The long arc column discharge tube of claim 1, wherein the cathode is isolated from the light exit window by an integral exit window shield preventing cathode material sputter from depositing on the light exit window.

11. The long arc column discharge tube of claim 10, wherein the exit window shield is spaced apart from the long column structure.

12. The long arc column discharge tube of claim 10, wherein the exit window shield is an integral part of the discharge column.

13. The long arc column discharge tube of claim 10, wherein exit window shield is made from a material selected from metal, ceramic, and a material that is compatible with the gas discharge environment.

14. The long arc column discharge tube of claim 1, wherein:

the light exiting the light exit window is shaped by the diameter and length of the first discharge path; and an exit angle of the light from the first discharge path is defined by the length and diameter of the beam shaping column.

15. The long arc column discharge tube of claim 1, wherein a beam shaping column of some length separates the first discharge path from the exit window, reducing light exit window contamination by anode portion sputter.

16. The long arc column discharge tube of claim 1, wherein the anode resides in an anode enclosure integral to the long column structure, the anode comprising one of:

hemispherical dome shape;

a flat disk shape;

a sharp pointed cone shape; and a truncated cone shape.

17. The long arc column discharge tube of claim 1, wherein the anode resides in an anode enclosure integral to the long column structure, the anode comprising one of:

a refractory metal; and a chemically doped refractory metal.

18. The long arc column discharge tube of claim 1, wherein the anode resides in an anode enclosure integral to the long column structure, the anode material is selected Thorium doped Tungsten and Cerium doped Tungsten.

19. The long arc column discharge tube of claim 1, wherein the anode resides in an anode enclosure integral to the long column structure and is offset from a centerline of the first discharge path.

20. The long arc column discharge tube of claim 1, wherein the anode is offset from the narrow passage of the long column structure and the light exit window, reducing contamination of the light exit window by anode sputter.

21. The long arc column discharge tube of claim 1, wherein a second window resides in a base of the hermetically sealed container, enabling an external light source to add different wavelength emissions to the emissions of the long arc column discharge tube and exit through the light exit window.

22. The long arc column discharge tube of claim 1, wherein the exit window is in the shape of a lens, enabling the light from the first discharge path to be focused at an external location.

23. The long arc column discharge tube of claim 1, wherein the exit window is formed by a series or combination of lenses, enabling the light from the first discharge arc path to be focused at an external location.

24. The long arc column discharge tube of claim 1, wherein the exit window has a different thermal expansion than the hermetically sealed container and is attached to the hermetically sealed container by intervening thermal expansion material, such that little or no stress is applied to the exit window.

25. The long arc column discharge tube of claim 1, wherein a lens having different thermal expansion than the hermetically sealed container is sealed to the hermetically sealed container by intervening thermal expansion material, such that little or no stress is applied to the lens.

26. A long arc column discharge tube comprising:

a hermetically sealed container made from a gas impermeable material and containing a gas and made from a non-conductive material coated to be impermeable to the gas contained therein;

an anode residing in the hermetically sealed container in the base of a long column structure;

a cathode residing in the hermetically sealed container and supported by a pair of horizontally separated cathode stems and residing to the side of the long column structure;

the long column structure residing in the hermetically sealed container, the long column structure including:

a narrow passage through the center of the long column structure;

a first discharge path in the narrow passage, the first discharge path creating light discharged from the narrow passage through the light exit window, wherein the discharged light is proportional to a gas density in the hermetically sealed container and is proportional to electric discharge current in the gas;

the first discharge path having a narrow column between the anode and cathode, wherein the length of the narrow column enables summation of light emitting photons along the narrow column length, and the length of the narrow column in conjunction with the diameter of the narrow column, shapes the light output from the first discharge path;

a second discharge path perpendicular to the first discharge path and aligned with the cathode; and a beam shaping column at the top of the long column structure having a length and diameter to control the shape of the light discharged from the long arc column discharge tube; and a light exit window in the top of the hermetically sealed container aligned with the beam shaping column.

27. A long arc column discharge tube comprising:

a hermetically sealed container made from material selected from ceramic, glass, and an internally coated material and containing a gas and made from a non-conductive material coated to be impermeable to the gas contained therein;

an anode residing in the hermetically sealed container in the base of a long column structure;

a cathode residing in the hermetically sealed container and supported by a pair of horizontally separated cathode stems and residing to the side of the long column structure, the cathode stems supported by the long column structure;

the long column structure residing in the hermetically sealed container, the long column structure including:

a narrow passage through the center of the long column structure;

a first discharge path in the narrow passage, the first discharge path creating light discharged from the narrow passage through the light exit window, wherein the discharged light is proportional to a gas density in the hermetically sealed container and is proportional to electric discharge current in the gas;

the first discharge path having a narrow column between the anode and cathode, wherein the length of the narrow column enables summation of light emitting photons along the narrow column length, and the length of the narrow column in conjunction with the diameter of the narrow column, shapes the light output from the first discharge path; and a second discharge path perpendicular to the first discharge path and aligned with the cathode; and a light exit window in the top of the hermetically sealed container aligned with the beam shaping column.

* * * * *